United States Patent [19]

Schwing

[11] 4,178,142

[45] Dec. 11, 1979

[54] DOUBLE-CYLINDER PUMP ESPECIALLY FOR CONVEYING CEMENT

[75] Inventor: Friedrich Schwing, Herne, Fed. Rep. of Germany

[73] Assignee: Friedrich Wilh. Schwing GmbH, Herne, Fed. Rep. of Germany

[21] Appl. No.: 817,667

[22] Filed: Jul. 21, 1977

[30] Foreign Application Priority Data

Jul. 21, 1976 [DE] Fed. Rep. of Germany ..... 2632816

[51] Int. Cl.[2] ..... F04B 15/02

[52] U.S. Cl. ..... 417/516; 417/519; 417/532; 417/900

[58] Field of Search ..... 417/516, 517, 519, 900, 417/532; 251/77; 137/616

[56] References Cited

U.S. PATENT DOCUMENTS 3,726,614 4/1973 Shellenberg ..... 417/517

3,929,400 12/1975 Merten et al. ..... 417/900 X 3,989,420 11/1976 Taylor ..... 417/517

FOREIGN PATENT DOCUMENTS 2362670 6/1975 Fed. Rep. of Germany ..... 417/900

OTHER PUBLICATIONS

Baumaschinendienst, May 1976, p. 234.

*Primary Examiner*—Carlton R. Croyle
*Assistant Examiner*—R. E. Gluck
*Attorney, Agent, or Firm*—Andrus, Sceales, Starke & Sawall

[57] ABSTRACT

In a double-cylinder pump for conveying cement, a distribution pipe is pivotally driven into alignment with each of the cylinders in turn. A wearing ring, which provides a seal between the end of the pipe and the cylinders, is mounted so as to be movable with respect to the end of the pipe so as to be able to assimilate wear.

9 Claims, 13 Drawing Figures

DOUBLE-CYLINDER PUMP ESPECIALLY FOR CONVEYING CEMENT

BACKGROUND OF THE INVENTION

This invention relates to a double-cylinder pump especially for the conveying of cement from an input feed container with two openings each leading to a respective one of two conveying cylinders, in front of which openings one end of a driven distribution pipe is pivotable, said one end being sealed with the aid of a fixed spectacles-shaped plate and an axially arranged, preferably adjustable, wearing ring.

With pumps of this kind which are used generally for the conveying of viscous porridge-like masses, in practice mainly cement, the cement which is to be conveyed flows into one conveyor cylinder from the input feed container whilst the other conveyor cylinder which has been filled by the previous stroke, delivers its contents through the distribution pipe into a conveyor conduit connected to the input feed container.

The drive serves for delivering the necessary movement energy for the swivelling movement of the distribution pipe corresponding to the respective strokes of the pump. The end of the distribution pipe nearer to the conveyor cylinder must be sealed so that on pressure strokes of the conveyor cylinder, leakage, particularly of liquid and fine grained components of the conveyed medium, between the cylinder opening and the distribution pipe is prevented. With the conveying of cement, there exists the danger that such leakage could cause weakening of the cement mix. On the one hand, the seal must withstand the pressures which result from the considerable conveying heights over which modern cement pumps must operate. On the other hand the seal must permit the assimilation of the wear which occurs between the movable and fixed parts of the seal.

It is known to install the wearing ring in a spectacles-shaped plate (i.e. a plate containing two apertures side by side) for each conveyor cylinder opening, and to install the shaft of the distribution pipe drive so that it can be adjusted axially, thereby allowing the end of the distribution pipe on the side of the conveyor cylinder to be displaced to assimilate the wear between the wearing ring and the openings of the spectacles-shaped plate in the preliminary feed container U.S. Pat. No. 3,726,614. Whilst, in this known device, the shaft of the distribution pipe drive can be adjusted with a screwed-on nut, there can, with a further, also previously known, device of this kind, also be provided an additional pressure screw which acts between the distribution pipe and a swivel lever connected to the shaft (German Offenlegungsschrift No. 2362670).

It is furthermore known, to mount the wearing ring so that it is slightly displaceable axially on the end of the distribution pipe nearer to the conveyor cylinder and to leave a groove between the end of the distribution pipe and the ring, in which groove the hydrostatic pressure of the conveyed medium acts on the one face, on one side of the ring, and on the other face on, the end side of the distribution pipe. By this, the distribution ring should be automatically pressed on to the spectacles-shaped plate, and thus be adjusted in accordance with the wear with the aid of the hydrostatic pressure. (Zeitschrift Baumaschinendienst, issue May 5, 1976, page 234).

Practical experience with seals of this kind shows that cement pumps thus installed do not function satisfactorily. On the one hand, the wear is uneven in so far as the path lengths traversed by the different paths during swivelling of the distribution pipe differ appreciably from each other. For this reason, increased wear occurs with increases in the distance from the pivot shaft. This uneven wear occurs after a relatively short time of operation because the distance between the pivot axis and the cylinder openings is kept as small as possible. The wear can however not be completely assimilated by axial adjustment of the wearing ring. Apart from this, the distributor pipe is pivoted out of the plane of the spectacles-shaped plate by the hydrostatic pressure of the conveyor medium because of the elastic deformation of the body of the pipe, and/or because of the necessary play in the mounting of the distribution pipe. In this manner a gap occurs which is largest in the areas furthest, removed from the pivoting shaft of the drive. If however the task of pressing the wearing ring is left to the hydrostatic pressure alone, then the wearing ring can, when operating against a low conveying resistance, be moved away from the spectacles-shaped plate by the entry of sand or foreign bodies between the two elements, which effect can lead to jamming of the distribution pipe.

The essential task of the invention is to form the seal at the end of the distribution pipe nearer to the conveyor cylinder in such a manner that deterioration of the seal owing to the influence of distortion and displacement because of the hydrostatic pressure can not occur. In a preferred embodiment of the invention uneven wear can be compensated in a pump which has a relatively short distance between the pivot shaft and the cylinder openings.

According to the invention this task is resolved in that the wearing ring is located on a clamping or pressing device and the pipe end and the wearing ring are arranged to be movable with respect to each other and sealed off against each other.

Thus the invention provides a double-cylinder pump, comprising an input container with two openings, two conveyor cylinders each in communication with a respective one of said openings, a driven distribution pipe with one end pivotally movable between the two openings which end is sealed with the aid of a fixed spectacles-shaped plate surrounding said openings an axially arranged wearing ring for sealing said pipe end to the spectacles-shaped plate and a clamping device on which the wearing ring is positioned, the end of the distribution pipe and the wearing ring being arranged to be movable with respect to each other and sealed off one against the other.

For preference, the clamping device is coupled to a drive for the pivotal movement of the distribution pipe and furthermore the wearing ring for its part is located so that it can be pivoted.

In that the wearing ring is connected to a clamping device not influenced by the distribution pipe, and that the end of the distribution pipe nearer to the conveyor cylinder is sealed so as to be movable relative to the wearing ring, the condition is created that unavoidable movements of the distribution pipe and the action of the conveying pressure have no unfavourable influence on the tightness of the metallic seal between cylinder openings and the wearing ring. On the other hand, the movable locating of the end of the distribution pipe in the wearing ring permits pivotal movement of the wearing ring with respect to the end of the pipe which, for its part, permits the seating of the wearing ring on the spectacles-shaped plate, even after uneven wear, for example by the known axial displacement, of the pivot shaft. Under these conditions, the wearing ring engages with the spectacles-shaped plate over its entire periphery because the wearing ring correspondingly pivots and, by this, makes possible an overall assimilation of varying wear. The sealing of the end of the pipe to wearing ring does not present a problem. The advantages which can be achieved by the invention lie principally in that, with considerable conveying heights, and correspondingly high pressures, absolutely tight connections of the distribution pipe to the cylinder openings can be attained and that if need be, by using known auxiliary arrangements, the varying wear can be compensated and the appearance of additional spaces in the sealing, which can lead to lack of tightness, can be prevented.

Preferably, pivot pins are used for the pivotable positioning of the wearing ring through which pivot pins runs the pivot axis of the wearing ring. According to an embodiment of the invention the pivot pins are located directly on a lever, which forms part of the distributor pipe drive. In another embodiment of the invention bearings are used which consist of convex and concave segments.

In a further embodiment of the invention a frame is provided which is adjustably mounted with respect to the spectacles-shaped plate, and which serves for the guiding of the moving part of the seal. The end of the pipe can be movably positioned and sealed in the wearing ring and/or a guide ring can be connected to the wearing ring. Other embodiments of the invention provide for the positioning and sealing of the wearing ring in the end of the pipe.

BRIEF DESCRIPTION OF THE DRAWINGS

Details, further characteristics and other advantages of the invention will be apparent from the following description of several embodiments thereof, with reference to the accompanying drawings, in which.

In the various illustrated embodiments, the same reference numbers refer to the corresponding parts.

DETAILED DESCRIPTION OF THE PREFERRED EMBODIMENT

Figure 1:
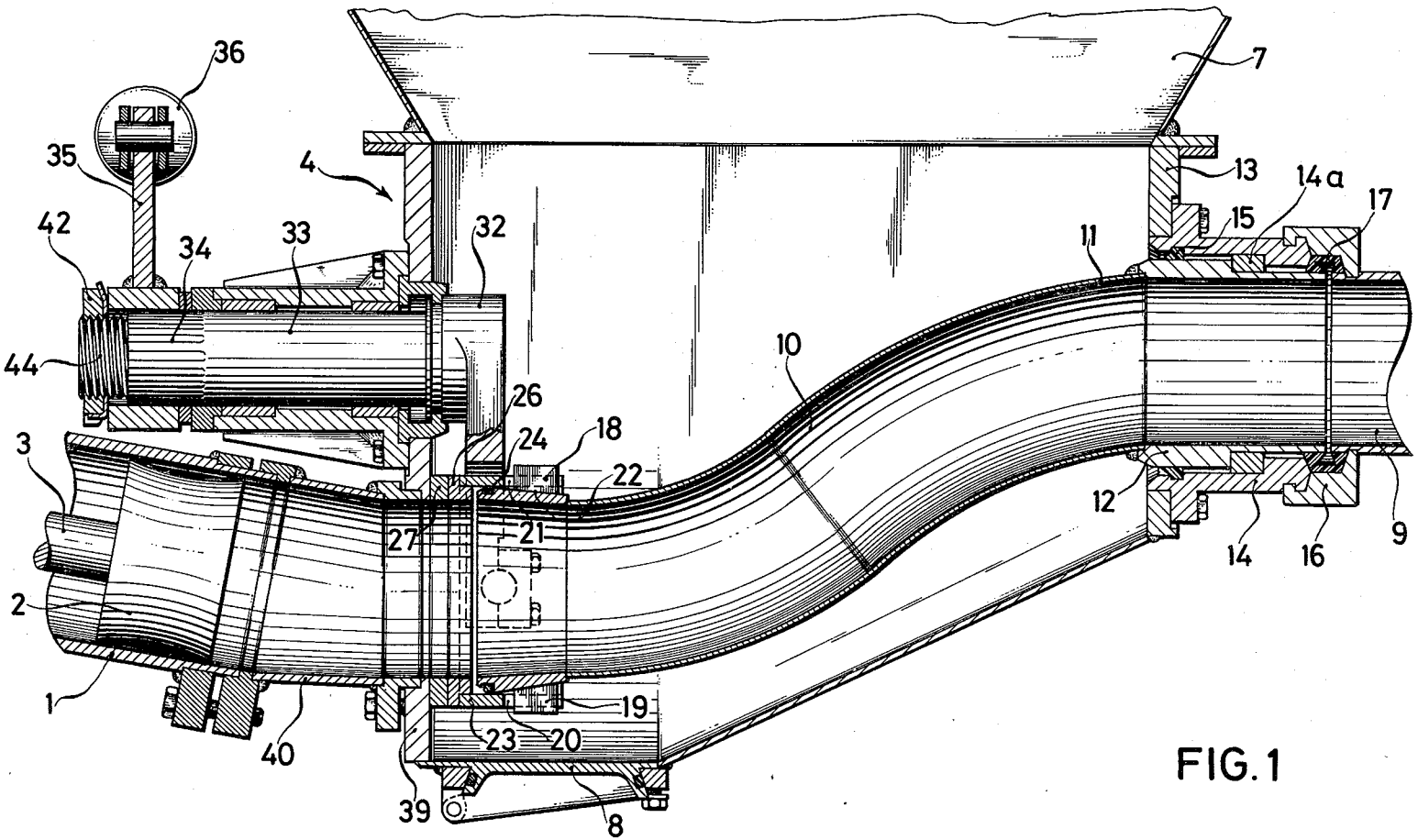
FIG. 1 is a longitudinal section of a preferred embodiment of the invention shown in part representation.
Figure 2:
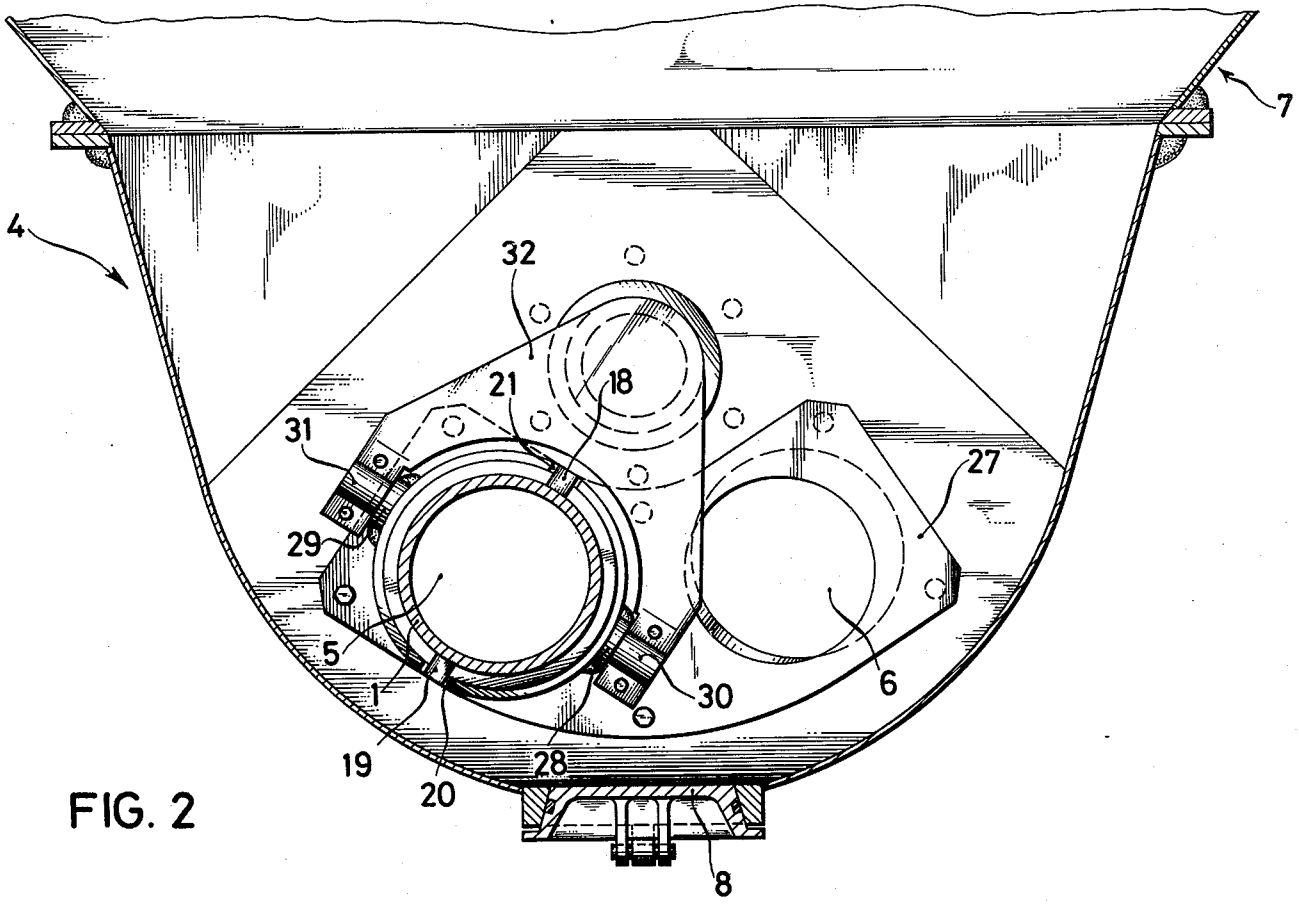
FIG. 2 is an end view of the embodiment according to FIG. 1 partly in cross-section.
Figure 3:
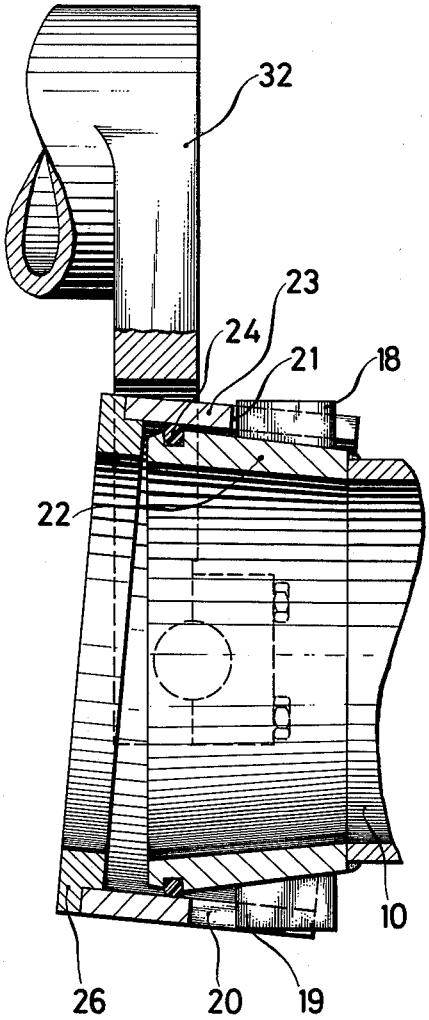
FIG. 3 shows the seal of the embodiment shown in FIGS. 1 and 2 after it has been subject to wear, FIG. 4 a plan view corresponding to FIG. 3, the positioning of bearings being shown partly in section.

In FIGS. 1 and 2 part of one of two conveyor cylinders 1 is shown in section. In the conveyor cylinder 1, a piston 2 moves with a piston rod 3 in such a manner that, on the retraction of the piston 2 cement is sucked from an input container 4, and, on the piston moving forward, the cement can be pressed out of the cylinder 1. The input container has two openings 5 and 6, each corresponding to a respective cylinder as can be seen from FIG. 2. The input container has, in the embodiment illustrated, a filling funnel 7 and an opening which can be closed with a lid 8 at its lowest part. The two openings 5 and 6 are alternatively connected to the end of a pipe 9, located outside the input container 4, through which pipe the cement sucked from the conveyor cylinder is conveyed.

The necessary distribution of the cement for this purpose is effected by means of an S-shaped distribution pipe 10, one end 11 of which is pivotally connected and sealed to the conduit 9. For this purpose the end 11 is welded to a hollow cylinder 12, which is fitted into a sleeve 14 screwed to an outer part 13 and supported therein by a ring 14*a*. Furthermore a seal 15 is provided between the cylinder 12 and the sleeve 14. The end of the pipe 9 is fastened in position by a sleeve 16 and a correspondingly formed seal 17. A hollow body 22 is welded to the end of the distributor pipe 10 nearer to the cylinders. The hollow body 22 has two cams 18 and 19 respectively, off-set at 180°, which, together with slots 20 and/or 21 in a guide ring 23, provide for movable positioning of the end of the pipe 22. Furthermore, the end of the pipe 22 is sealed off in the guide ring 23 by means of a sealing ring 24.

The one side of the guide ring 23 carries a wearing ring 26 which is supported, on the one side, on said side of the guide ring 23 and, on the other side, on a spectacles-shaped plate 27. Because the guide ring 23 is provided with two pivot pins 28 and 29 off-set with respect to each other by 180°, the wearing ring 26 can also pivot so that it, can align itself with the surface of the spectacles-shaped plate 27 independently of the amount of wear over its surface. For this purpose, the pivot pins 28 and 29 are located in respective pivot bearings 30 and 31 of a fork-shaped lever 32 which is fastened by a lug to the end of a pivot shaft 33 within the input container 4. The pivot shaft 33 is connected by a spline and groove connection 34 to a drive lever 35 which is movable reciprocably by a motor 36 which is not shown in detail.

Figure 4:
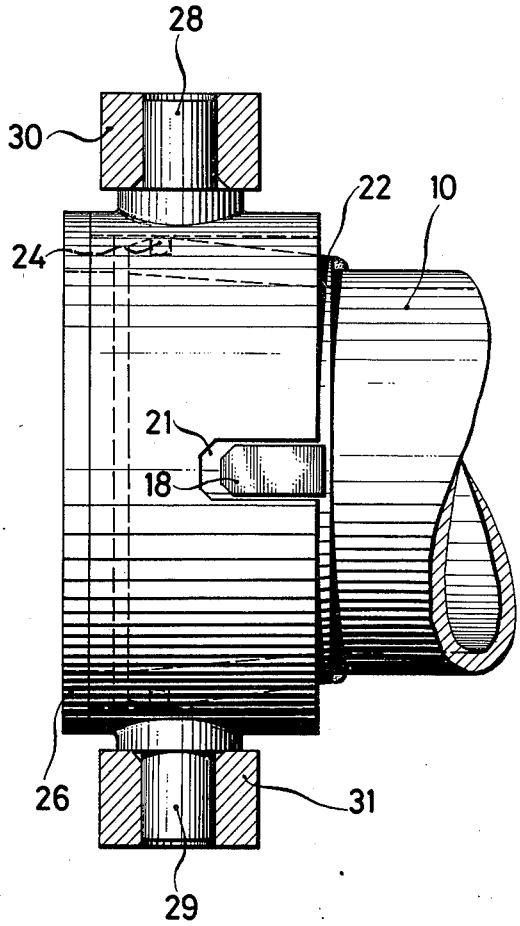

The spectacles-shaped plate 27 abuts against a reinforced wall 39 of the input container, which for its part has a respective recess for the connection of a connecting piece 40 to each conveyor cylinder. Initially, the parts assume the relative positions shown in FIGS. 1, 2 and 4. However, as soon as wear occurs, the sealing arrangement must be adjusted. In the embodiment illustrated, a nut 42, screwed on to the outer end 44 of the pivot shaft 33 serves for this purpose. On tightening the nut 42, the pivot shaft 33 moves axially, so that, by means of the pivot lever 32 and the pin positioning means 28 to 31, the guide ring 23, and with it also the wearing ring 26 are similarly moved. Because of the pin positioning means, the guide ring 23 can be swivelled together with the wearing ring 26 about a swivelling axis passing through the pins 28 and 29. Consequently the plane of the wearing ring 26 allows itself to be changed with respect to the plane of the spectacles-shaped plate 27. In this way, it is possible to assimilate the more severe wear which occurs, at the lower end of the wearing ring in the illustrated embodiment, even if, the pipe end 22 has retained its original position and/or has swivelled under the influence of the hydrostatic pressure in the opposite direction. The illustrated mechanical adjustment means, employing the nut 42, can, of course, be replaced by an automatic arrangement employing a hydraulic tightening cylinder or spring clamping elements.

Figure 5:
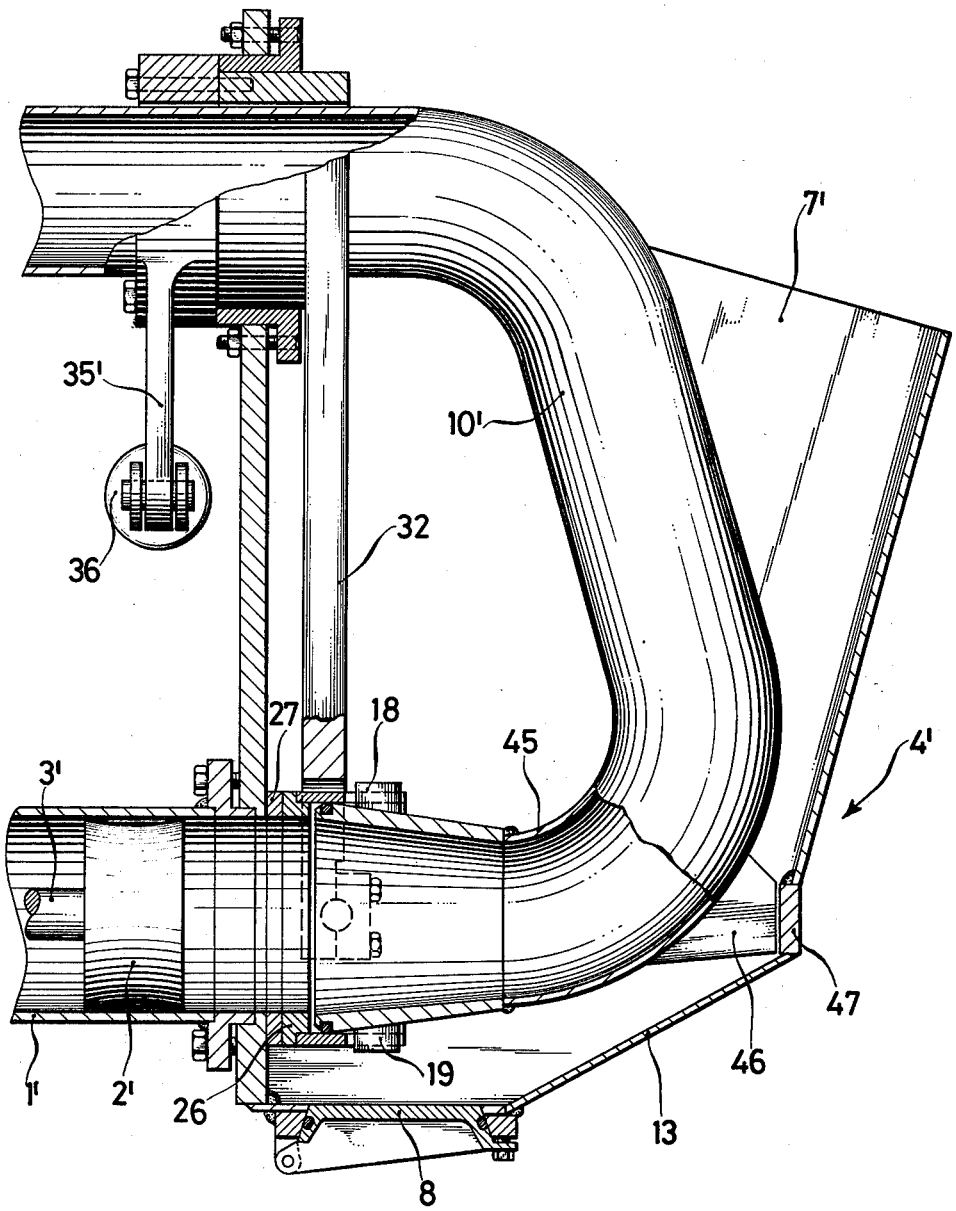
FIG. 5 shows an embodiment of the invention with a modified form of distribution pipe.

In the embodiment shown in FIG. 5, the shape of the distribution pipe has been changed from an S shape to a U shape. The lower bend 45 of the distribution pipe 10 carries a support 46 for engagement with an abutment 47, which is mounted on the lower part 13 of the input container 4. In this way, the hydrostatic forces which act on the U-shaped distribution pipe 10 are balanced. The remaining parts correspond to the arrangement which are shown in FIGS. 1 to 4 and have been explained as above. The only thing that is omitted is the tightening device.

Figure 6:
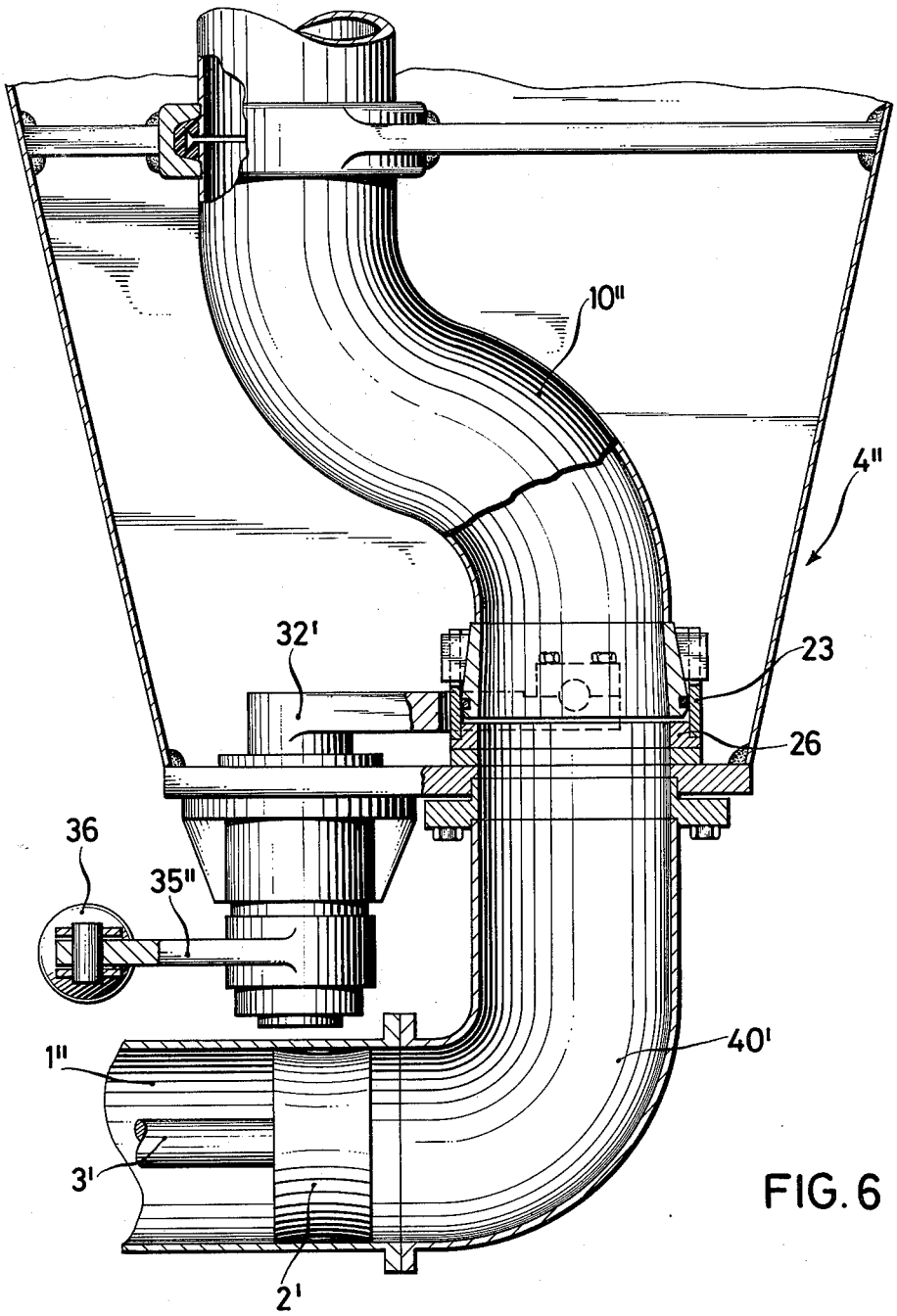
FIG. 6 shows an embodiment of the invention with a further modified distribution pipe.

The embodiment shown in FIG. 6 differs from the embodiment according to FIGS. 1 to 4 in that, although an S-shaped distributor pipe 10 is used, it is arranged not horizontally but vertically in the input container 4. For this reason, the connecting piece 40 is bent through more than 90°.

Figure 7:
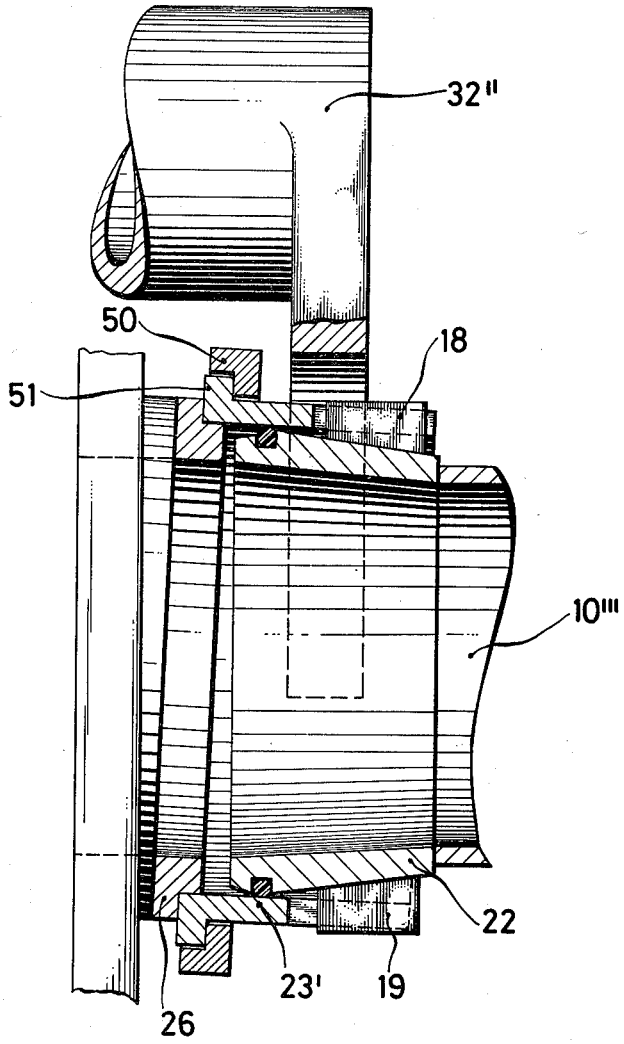
FIG. 7 shows a modified embodiment of the invention in which a frame is used for the pressing of the wearing ring, shown in section.
Figure 8:
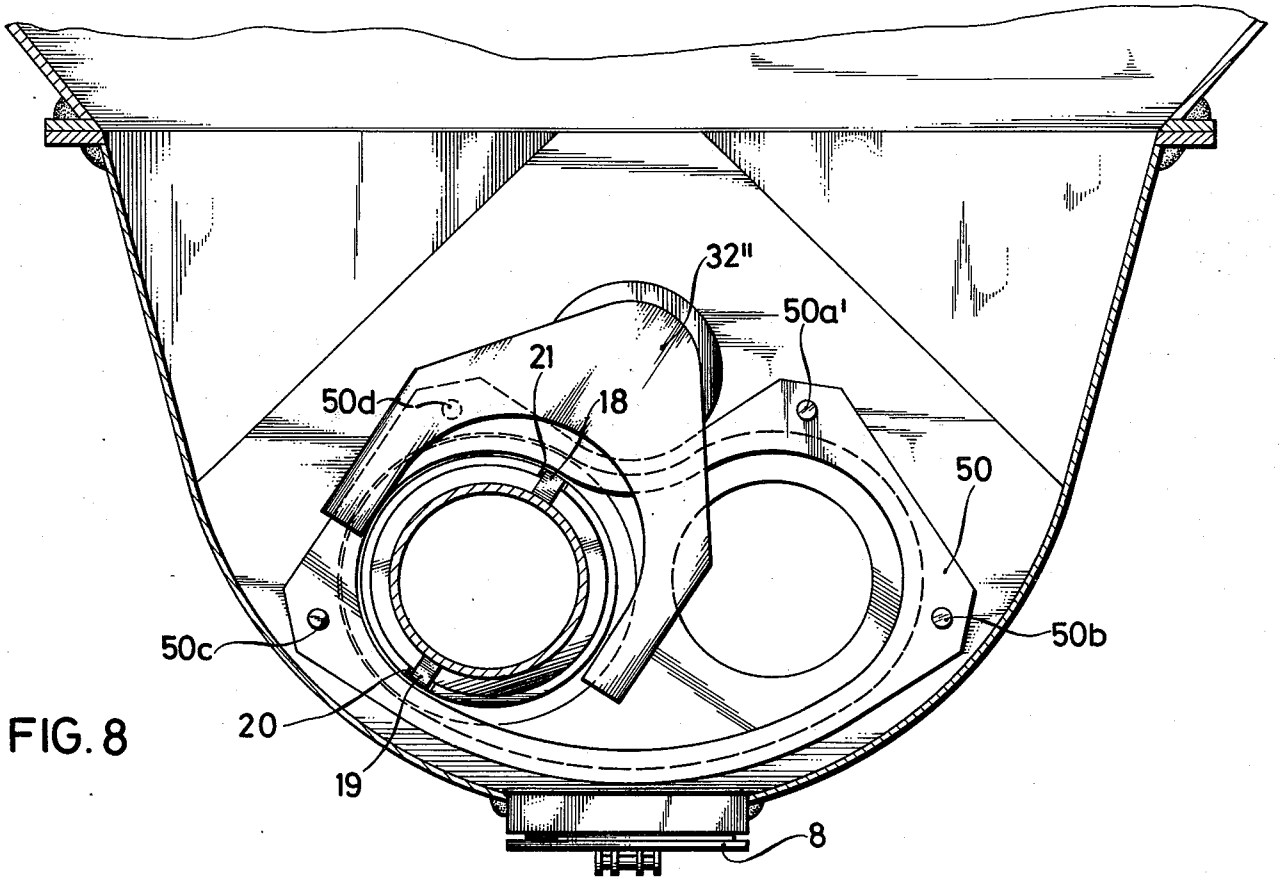
FIG. 8 is an end view, corresponding to FIG. 2, of the embodiment shown in FIG. 7.

In the embodiment shown in FIG. 7, the arrangement used for the sealing of the pipe end 22, at the conveyor cylinder side of the swivel pipe 10, differs from the embodiments shown in FIGS. 1 to 6. Here, the guide ring 23 sits in a frame 50, but again carried on its end side 51, the wearing ring 26. The apparatus illustrated in FIG. 7, has already been subject to uneven wear and the drawing corresponds to this extent to FIG. 3. As can be seen from FIG. 8, the frame 50 in the embodiment shown in FIG. 7 can be adjusted with the aid of several adjustment screws 50*a* to 50*d* to compensate for the wear with respect to the spectacles-shaped plate shown in FIG. 7. In a corresponding manner, the guide ring 23 adjusts itself to the plane of the spectacles-shaped plate, and the wearing ring 26 can follow the uneven wear. On the other hand, the distribution pipe is directly attached to the pivot shaft. A swinging positioning of the distribution pipe relative to the pivot shaft is not necessary. Tightening up takes place with the aid of the adjustment screws 50*a* to 50*d* over the frame 50.

Figure 9:
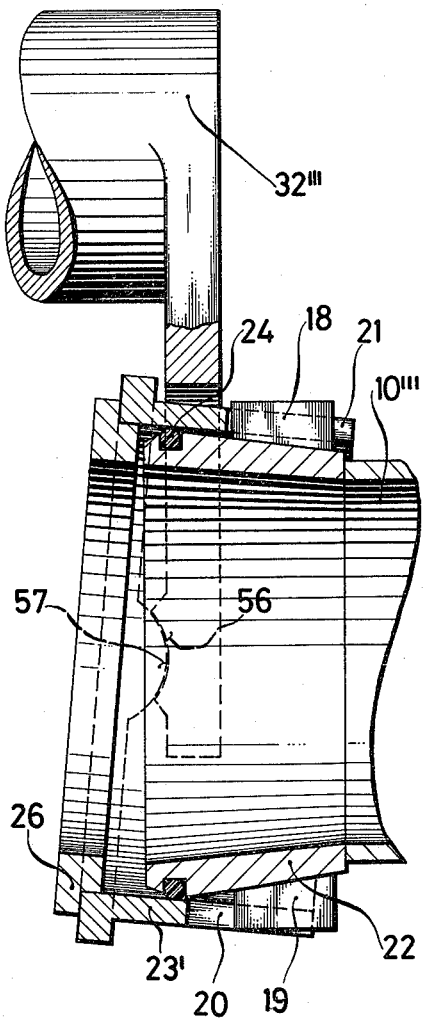
FIG. 9 shows a modified embodiment of the object of the invention in a view corresponding to FIG. 3.
Figure 10:
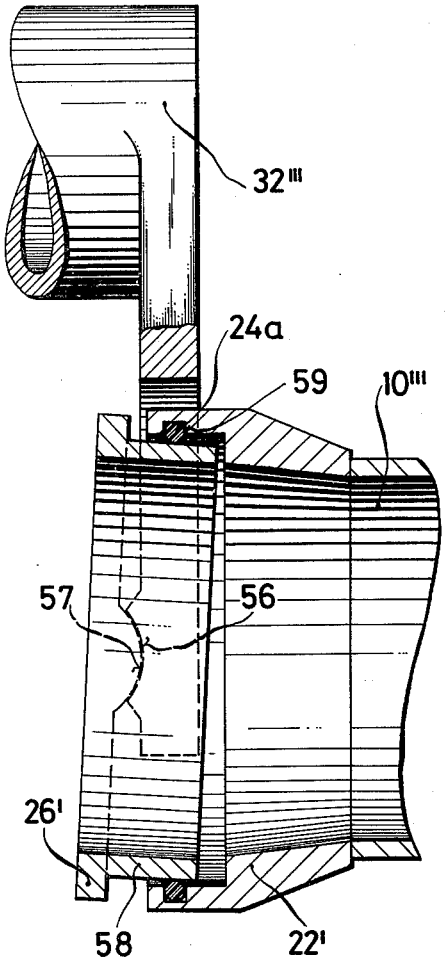
FIG. 10 shows a modification of the embodiment of FIG. 9.

In the embodiments shown in FIGS. 9 and 10 the arrangement of the swivel pins is modified. For this purpose, the lever 32 has a bearing which consists of concave segements 56 for respective convex cams 57 provided on the guide ring 23, the wearing ring 26 being positioned once again on the end side of the guide ring 23.

The embodiment according to FIG. 10 differs from the embodiment according to FIG. 9 in that, the wearing ring 26 is disposed within the interior of the end 22 of the swivel pipe 10 and sealed thereto by an annular seal 24*a*, which is supported on a hollow cylindrical extended end 58 of the wearing ring 26 and contained in a groove 59 in the inner side of the pipe end 22. This arrangement has the advantage that, as compared with the embodiment according to FIGS. 1 to 9 a smaller number of individual parts are required.

Figure 11:
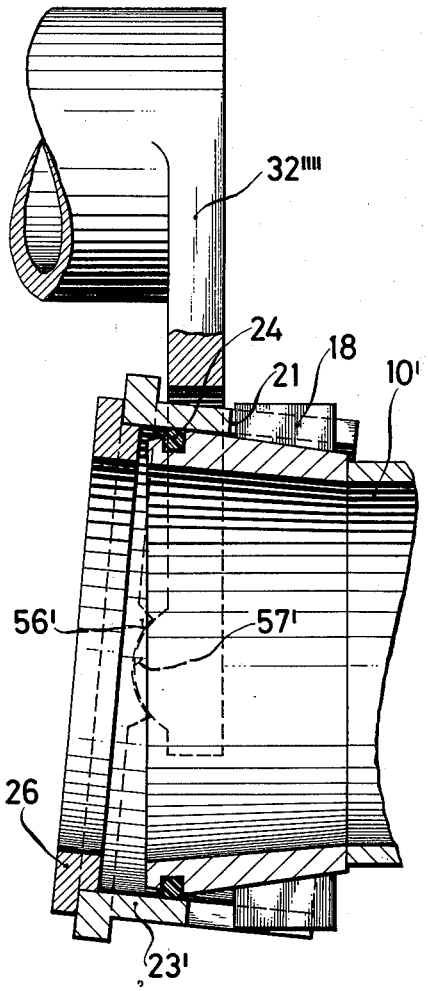
FIG. 11 shows a modified embodiment of the invention in a view corresponding to FIG. 3.
Figure 12:
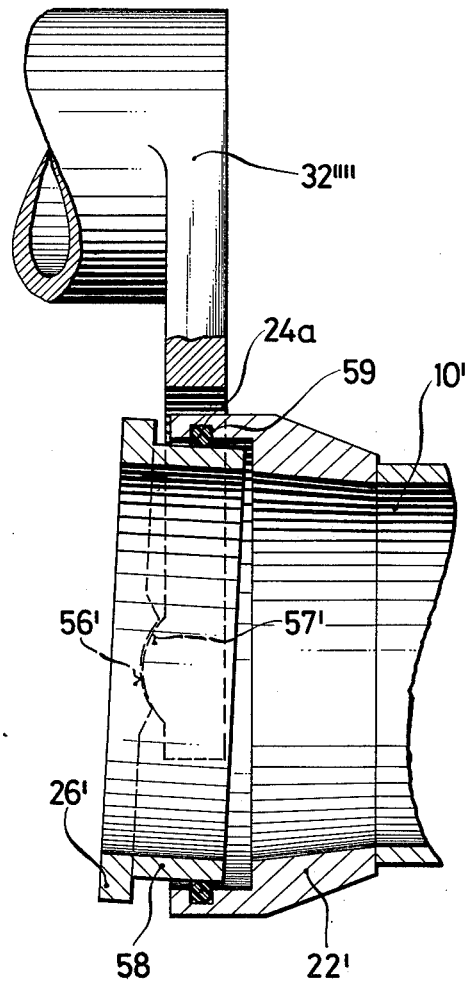
FIG. 12 shows a further modified embodiment of the invention in a view corresponding to FIG. 3.

The embodiments shown in FIGS. 11 and 12 are modified with respect to the embodiments of the FIGS. 9 and 10 in that in these cases the concave segments 56 are formed on the guide ring 23 (FIG. 11) or directly on the wearing ring 26 (FIG. 12) instead of at the end of the fork prongs of the lever 32. For this reason, the cam 57 in these embodiments is on the arms of the fork of the lever 32.

Figure 13:
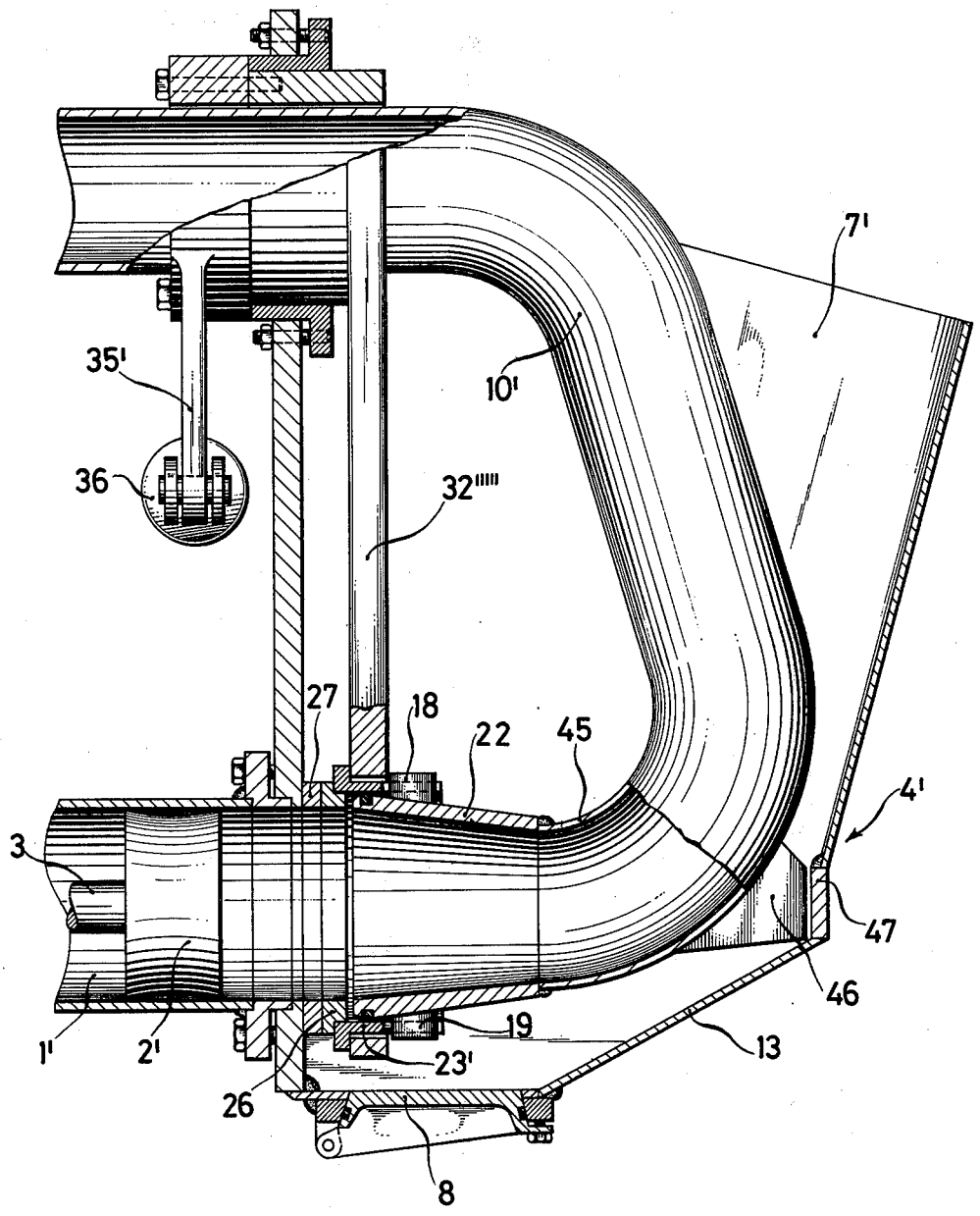
FIG. 13 shows a further embodiment of the invention with the means for positioning of the wearing ring modified as compared to FIG. 5.

The embodiment shown in FIG. 13 differs from the embodiment shown in FIG. 5 in that, the guide ring 23 in the lever 32 can no longer be swivelled but is firmly fixed. This is acceptable because of the relatively larger distance of the swivel shaft from the conveyor cylinder 1 so that the uneven wear of the wearing ring 26 is negligible with the result that it is possible in spite of omitted constructive links, to apply the wearing ring 26 to the spectacles-shaped plate 27 over its entire surface.

In all the embodiments of the invention, the pipe end 22 which provides for a positioning of the end of the pipe 10 in the guide ring 23 is bell-shaped. The sealing ring 24 is made from elastic material.

I claim:

1. A double cylinder pump for a viscous, abrasive material comprising:

frame means having a pair of material conveyor cylinders providing a pair of delivery openings surrounded by a spectacle shaped plate;

a driven distribution pipe having an end swivellingly movable between said two openings for receiving the discharge of said cylinders;

a wearing ring carried by said distribution pipe adjacent its end for contacting said spectacle shaped plate throughout the swivelling movement of said pipe; and a pressure device anchored in said frame means and coupled to said wearing ring for forcing said wearing ring into contact with said spectacle shaped plate, said wearing ring being relatively movable with respect to said pressure device and said pipe responsive to the contact with said spectacle shaped plate to obtain sealing abutment between said ring and plate and for accommodating wear to said ring and plate from the viscous, abrasive material.

2. A double-cylinder pump according to claim 1 wherein the wearing ring is mounted in bearings in said pressure device.

3. A double cylinder pump according to claim 1 wherein said pump further includes a drive means for said distribution pipe mounted on frame means and wherein said pressure device is included in said drive means.

4. A double-cylinder pump according to claim 2 further including pivot pins on which the wearing ring is mounted for pivoting and wherein said pressure device includes a forked lever connected to a drive shaft for said distribution pipe and provided with bearing holes for the pivot pin.

5. A double-cylinder pump according to claim 4, wherein the pivot pins are arranged on a guide ring in which the end of the distribution pipe is movably positioned and to which it is sealed, the wearing ring being braced against the guide ring.

6. A double cylinder pump according to claim 2 wherein a bearing arrangement consisting of concave segments and convex segments on said wearing ring and pressure device serve for the pivotal positioning of the wearing ring.

7. A double-cylinder pump according to claim 6, further comprising a forked lever connected to a drive shaft for said distribution pipe and a guide ring on which the wearing ring is mounted, the convex segments being arranged on the guide ring and the concave segments on the fork of the lever.

8. A double-cylinder pump according to claim 1, wherein the wearing ring is positioned within the end of the distribution pipe.

9. A double cylinder pump according to claim 1 wherein the wearing ring is positioned about the exterior of the end of said distribution pipe.

* * * * *